US007594817B2

(12) United States Patent
Wahlberg et al.

(10) Patent No.: US 7,594,817 B2
(45) Date of Patent: Sep. 29, 2009

(54) ELECTRICAL FLEX CONNECTOR FOR MOUNTING ON A PRINTED CIRCUIT BOARD

(75) Inventors: Magnus Karl Per Wahlberg, Stockholm (SE); John Tore Lennart Ledin, Ekero (SE)

(73) Assignee: Sony Ericsson Mobile Communications AB, Lund (SE)

( * ) Notice: Subject to any disclaimer, the term of this patent is extended or adjusted under 35 U.S.C. 154(b) by 0 days.

(21) Appl. No.: 12/055,778

(22) Filed: Mar. 26, 2008

(65) Prior Publication Data

US 2009/0209118 A1 Aug. 20, 2009

Related U.S. Application Data

(60) Provisional application No. 61/028,944, filed on Feb. 15, 2008.

(51) Int. Cl.
*H01R 12/00* (2006.01)

(52) U.S. Cl. ..... 439/67; 439/492; 439/493

(58) Field of Classification Search ..... 439/67, 439/492, 493

See application file for complete search history.

(56) References Cited

U.S. PATENT DOCUMENTS 4,169,641 A * 10/1979 Olsson ..... 439/493
4,252,389 A * 2/1981 Olsson ..... 439/65
4,634,195 A * 1/1987 Shoemaker ..... 439/493
5,462,441 A 10/1995 Renn et al.
7,374,430 B2 * 5/2008 Nagawatari ..... 439/67
2007/0232127 A1 10/2007 Lin
2008/0233793 A1 * 9/2008 Ju ..... 439/493

FOREIGN PATENT DOCUMENTS

JP 8-102342 4/1996

OTHER PUBLICATIONS

International Search Report and Written Opinion for International Application No. PCT/IB08/002057 dated Nov. 6, 2008.

* cited by examiner

*Primary Examiner*—Tho D Ta
(74) *Attorney, Agent, or Firm*—Renner, Otto, Boisselle & Sklar, LLP

(57) ABSTRACT

In one embodiment, an electrical connector for a printed circuit board includes a body having a fixation portion for affixing the connector to an associated printed circuit board. The fixation portion includes a first side formed between a second and third side. A first tab member extends from the first side, wherein the first tab member is configured to exert a compressive force on an associated flex connector to securely hold the associated flex connector between the first tab member and the associated printed circuit board.

18 Claims, 5 Drawing Sheets

ELECTRICAL FLEX CONNECTOR FOR MOUNTING ON A PRINTED CIRCUIT BOARD

RELATED APPLICATION DATA

This application claims priority from U.S. Provisional Application No. 61/028,944 filed Feb. 15, 2008, which is incorporated herein by reference.

TECHNICAL FIELD OF THE INVENTION

The present invention relates generally to electrical connectors for use on printed circuit boards and, more particularly, to an electrical flex connector configured to be mounted on or otherwise secured to a printed circuit board.

DESCRIPTION OF THE RELATED ART

Many electronic devices such as mobile telephones, computers, media players and so forth include printed circuit boards. Printed circuit boards also may be referred to as printed wire boards. The printed circuit board may retain one or more circuit components (e.g., integrated circuit packages) and may establish connectivity to contacts of the circuit components. For instance, the printed circuit board may include conductive electrical signal pathways to connect the circuit component to power, ground and/or other signals. In addition, the printed circuit board may include conductive electrical pathways to connect the circuit component to another component that is mounted on the printed circuit board (e.g., another integrated circuit package) or another component that is located remotely off of the printed circuit board so that signals may be exchanged between the circuit component and these other components.

Flex connectors are generally used to connect printed circuit boards to other printed circuit boards. Conventional flex connectors (e.g., standard BTB connectors) consume a substantial amount of space inside the electronic device, which generally requires electronic devices to be bulkier than otherwise desired.

SUMMARY

To reduce the size and cost of electronic devices utilizing multiple printed circuit boards, there is a need in the art for an electrical connector that is thinner; has stronger mechanical bonding properties; has increased electrostatic discharge (ESD) protection; and is less expensive to manufacture than conventional printed circuit board flex connectors.

One aspect of the invention relates to an electrical connector for a printed circuit board, the connector including: a body having a fixation portion for affixing the connector to an associated printed circuit board, wherein the fixation portion includes a first side formed between a second and third side; and a first tab member extending from the first side, wherein the first tab member is configured to exert a compressive force on an associated flex connector to securely hold the associated flex connector between the first tab member and the associated printed circuit board.

Another aspect of the present invention relates to the fixation portion being secured to the printed circuit board with a securing agent.

Another aspect of the present invention relates to the securing agent being a soldering agent.

Another aspect of the present invention relates to the soldering agent being a tin paste that when in a liquid form functions to position the connector on the associated printed circuit board by use of capillary forces.

Another aspect of the present invention relates to the first tab member including a first end extending in a cantilever manner from the first side and a second free end having an edge portion configured to facilitate receiving the associated flex connector.

Another aspect of the present invention relates to the second free end of the first tab member includes a contact portion adjacent the edge portion for contacting the associated flex connector.

Another aspect of the present invention includes alignment guides on the second and third sides of the fixation portion, wherein the alignment guides facilitate alignment of the associated flex connector in a lateral direction.

Another aspect of the present invention relates to the alignment guides being positioned a predetermined distance from the first side.

Another aspect of the present invention includes a spanning member formed in the body, wherein the spanning member extends upward from a plane formed from the second side and third side of the fixation portion and the spanning member when secured to the associated printed circuit board forms a port with the associated printed circuit board for receiving the associated flex connector.

Another aspect of the present invention includes a second tab member extending toward the first side to secure the flex connector in an axial direction.

Another aspect of the present invention relates to the second tab member including a first end extending in a cantilever manner from the spanning member and a second free end having an edge portion configured to facilitate removal of the associated flex connector from the port.

Another aspect of the present invention relates to the second free end of the second tab member includes a contact portion adjacent the edge portion for contacting the associated flex connector.

Another aspect of the present invention relates to the body being manufactured from spring steel.

Another aspect of the present invention relates to the connector being positioned over one or more contact patterns that form an electrical connection from the associated printed circuit board to the associated flex connector.

Another aspect of the invention relates to the second free end of the second tab member including a contact portion adjacent the edge portion for contacting the associated flex connector to secure the second tab member over one or more second contacts that form an electrical connection from the associated printed circuit board to the associated flex connector.

Another aspect of the invention relates to a second tab member extending from the spanning member in an opposite direction from the first side to secure the associated flex connector in an axial direction.

Another aspect of the invention relates to a third tab member extending from the spanning member toward the first side to secure the third tab member over one or more second contacts that form an electrical connection from the associated printed circuit board to the associated flex connector.

One aspect of the invention relates to a method of securing an electrical connector to a printed circuit board, the method comprising: forming one or more contact patterns on a printed circuit board; providing an electrical connector as described in the claims including a body having a fixation portion for affixing the connector to the printed circuit board, wherein the fixation portions includes a first side formed between a second and third side; and a first tab member extending from the first side, wherein the first tab member is configured to exert a compressive force on an associated flex connector to securely hold the associated flex connector between the first tab member and the associated printed circuit board; adhering a fixation pattern that corresponds to the fixation portion of the electrical connector to the printed circuit board, wherein the pattern is provided around at least a portion of the one or more contact patterns formed in the printed circuit board; and placing the electrical connector on the fixation pattern with a compressive force.

Another aspect of the present invention relates to the connector being placed on the fixation pattern of the printed circuit board with a pick and place machine.

Another aspect of the present invention relates to a method of using an electrical connector provided on a printed circuit board, the method including: providing one or more contact patterns on a printed circuit board; providing an electrical connector as described in the claims; receiving a flex connector at the port formed by the spanning member and the printed circuit board; and guiding the flex connector to the proper lateral position by sliding the connector against at least on of the alignment guides.

Another aspect of the present invention relates to upon engaging the second tab member, the flex connector exerts a force against the second tab member free end causing the free end of the second tab member to move and allow the flex connector to traverse past the second tab member and engage the one more or more contacts of the printed circuit board.

Another aspect of the present invention relates to when the flex connector is properly positioned in the electrical connector, the second tab member exerts a compressive force on the flex connector.

Another aspect of the present invention relates to upon engaging the first tab member, the flex connector exerts a force against the first tab member free end causing the free end to expand and allowing the flex connector to traverse below the first tab member and engage the one more or more contacts of the printed circuit board.

Another aspect of the present invention relates to when the flex connector is properly positioned in the electrical connector, the first tab member exerts a compressive force over at least a portion of flex connector contacts engaging the contacts on the printed circuit board.

These and further features of the present invention will be apparent with reference to the following description and attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the spirit and terms of the claims appended hereto.

Features that are described and/or illustrated with respect to one embodiment may be used in the same way or in a similar way in one or more other embodiments and/or in combination with or instead of the features of the other embodiments.

It should be emphasized that the terms "comprises" and "comprising," when used in this specification, are taken to specify the presence of stated features, integers, steps or components but do not preclude the presence or addition of one or more other features, integers, steps, components or groups thereof.

DETAILED DESCRIPTION OF EMBODIMENTS

Figure 1:
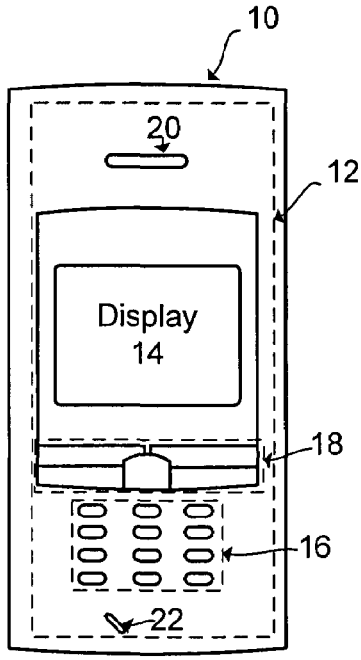
FIG. 1 is an illustration of an exemplary mobile telephone in accordance with aspects of the present invention.

Embodiments of the present invention will now be described with reference to the drawings, wherein like reference numerals are used to refer to like elements throughout. It will be understood that the figures are not necessarily to scale.

In the present application, the invention is described primarily in the context of an electrical connector for a printed circuit board for use in a mobile telephone. However, it will be appreciated that the invention is not intended to be limited to the context of a mobile telephone and may relate to an electrical connector for a printed circuit board used in any type of electronic equipment. Non-limiting examples of other types of electronic equipment include a media player, a gaming device, a computer, a video monitor, an appliance, and a global positioning system. Also, the interchangeable terms "electronic equipment" and "electronic device" include portable radio communication equipment. The term "portable radio communication equipment," which herein after is referred to as a "mobile radio terminal," includes all equipment such as mobile telephones, pagers, communicators, electronic organizers, personal digital assistants (PDAs), smartphones, portable communication apparatus or the like.

Referring to FIG. 1, a mobile telephone 10 is illustrated. The mobile telephone 10 may include a user interface 12 that enables the user easily and efficiently to perform one or more communication tasks (e.g., identify a contact, select a contact, make a telephone call, receive a telephone call, look up a telephone number, maintain various appointment logs, etc). The user interface 12 of the mobile telephone 10 generally includes one or more of the following components: a display 14, an alphanumeric keypad 16, function keys 18, a speaker 20, and a microphone 22.

The mobile telephone 10 includes a display 14. The display 14 displays information to a user such as operating state, time, telephone numbers, contact information, various navigational menus, status of one or more functions, etc., which enable the user to utilize the various features of the mobile telephone 10. The display 14 may also be used to visually display content accessible by the mobile telephone 10. The displayed content may include E-mail messages, geographical information, journal information, audio and/or video presentations stored locally in memory 24 (FIG. 2) of the mobile telephone 10 and/or stored remotely from the mobile telephone 10 (e.g., on a remote storage device, a mail server, remote personal computer, etc.). Such presentations may be derived, for example, from multimedia files received through E-mail messages, including audio and/or video files, from a received mobile radio and/or television signal, etc. The audio component may be broadcast to the user with a speaker 20 of the mobile telephone 10. Alternatively, the audio component may be broadcast to the user though a headset speaker (not shown).

The mobile telephone 10 further includes a keypad 16 that provides for a variety of user input operations. For example, the keypad 16 may include alphanumeric keys for allowing entry of alphanumeric information such as E-mail addresses, distribution lists, telephone numbers, phone lists, contact information, notes, etc. In addition, the keypad 16 typically may include special function keys such as a "call send" key for transmitting an E-mail, initiating or answering a call, and a "call end" key for ending, or "hanging up" a call. Special function keys may also include menu navigation keys, for example, for navigating through a menu displayed on the display 14 to select different telephone functions, profiles, settings, etc., as is conventional. Other keys associated with the mobile telephone 10 may include a volume key, audio mute key, an on/off power key, a web browser launch key, an E-mail application launch key, a camera key, etc. Keys or key-like functionality may also be embodied as a touch screen associated with the display 14.

The mobile telephone 10 includes conventional call circuitry that enables the mobile telephone 10 to establish a call, transmit and/or receive E-mail messages, and/or exchange signals with a called/calling device, typically another mobile telephone or landline telephone. However, the called/calling device need not be another telephone, but may be some other device such as an Internet web server, E-mail server, content providing server, etc.

Figure 2:
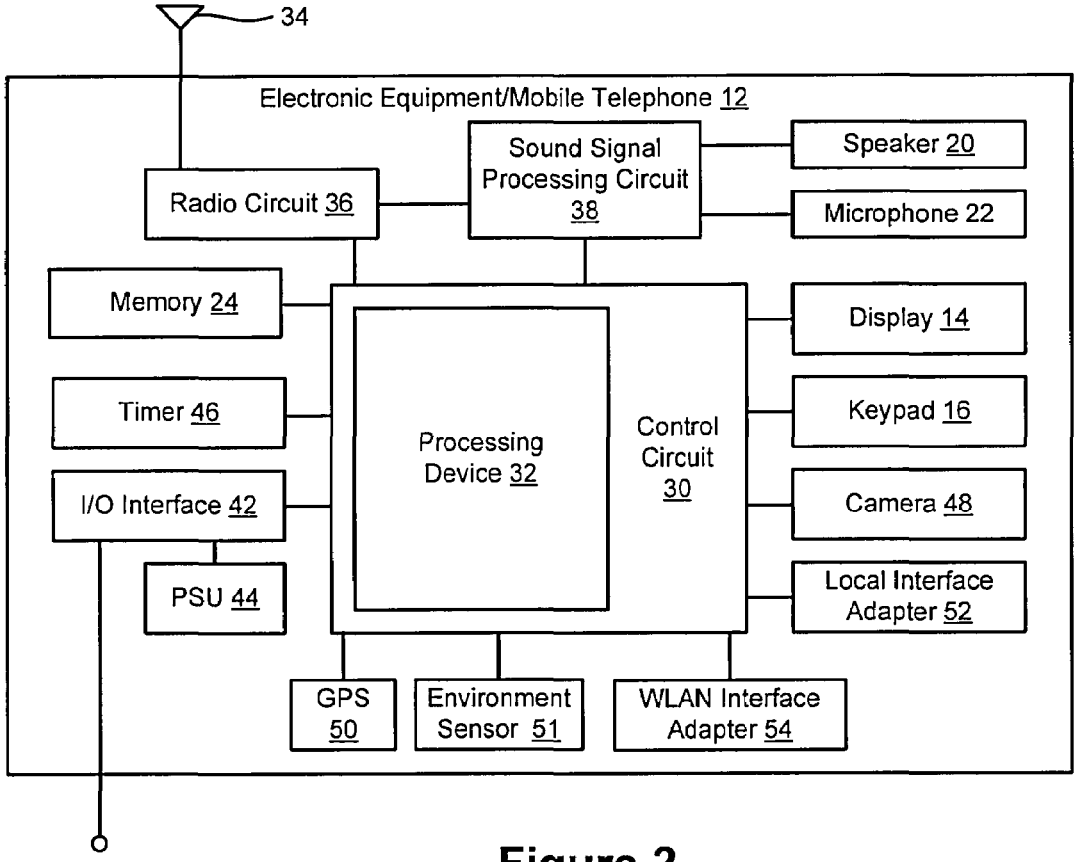
FIG. 2 is a schematic illustration of components of an exemplary mobile telephone in accordance with aspects of the present invention.

Referring to FIG. 2, a functional block diagram of an exemplary mobile telephone 10 is illustrated. The mobile telephone 10 includes a primary control circuit 30 that is configured to carry out overall control of the functions and operations of the mobile telephone 10. The control circuit 30 may include a processing device 32, such as a CPU, microcontroller or microprocessor. The processing device 32 executes code stored in a memory (not shown) within the control circuit 30 and/or in a separate memory, such as memory 24, in order to carry out operation of the mobile telephone 10. The memory 24 may be, for example, a buffer, a flash memory, a hard drive, a removable media, a volatile memory and/or a non-volatile memory.

Continuing to refer to FIGS. 1 and 2, the mobile telephone 10 includes an antenna 34 coupled to a radio circuit 36. The radio circuit 36 includes a radio frequency transmitter and receiver for transmitting and receiving signals via the antenna 34, as is conventional. The mobile telephone 10 generally utilizes the radio circuit 36 and antenna 34 for voice, data and/or E-mail communications over a cellular telephone network. The mobile telephone 10 further includes a sound signal processing circuit 38 for processing the audio signal transmitted by/received from the radio circuit 36. Coupled to the sound processing circuit 38 are the speaker 20 and a microphone 22 that enable a user to listen and speak via the mobile telephone 10 as is conventional. The radio circuit 36 and sound processing circuit 38 are each coupled to the control circuit 30 so as to carry out overall operation.

The mobile telephone 10 also includes the aforementioned display 14 and keypad 16 coupled to the control circuit 30. The mobile telephone 10 further includes an I/O interface 42. The I/O interface 42 may be in the form of typical mobile telephone I/O interfaces, such as a multi-element connector at the base of the mobile telephone 10. As is typical, the I/O interface 42 may be used to couple the mobile telephone 10 to a battery charger to charge a power supply unit (PSU) 44 within the mobile telephone 10. In addition, or in the alternative, the I/O interface 42 may serve to connect the mobile telephone 10 to a wired personal hands-free adaptor, to a personal computer or other device via a data cable, etc. The mobile telephone 10 may also include a timer 46 for carrying out timing functions. Such functions may include timing the durations of calls and/or events, tracking elapsed times of calls and/or events, generating timestamp information, e.g., date and time stamps, etc.

The mobile telephone 10 may include various built-in accessories, such as a camera 48 for taking digital pictures. Image files corresponding to the pictures may be stored in the memory 24. In one embodiment, the mobile telephone 10 also may include a position data receiver 50, such as a global positioning satellite (GPS) receiver, Galileo satellite system receiver or the like. The mobile telephone 10 may also include an environment sensor 51 to measure conditions (e.g., temperature, barometric pressure, humidity, etc.) in which the mobile telephone is exposed.

The mobile telephone 10 may further include a local wireless interface adapter 52, such as a Bluetooth adaptor to establish wireless communication with other locally positioned devices, such as the a wireless headset, another mobile telephone, a computer, etc. In addition, the mobile telephone 10 may also include a wireless local area network interface adapter 54 to establish wireless communication with other locally positioned devices, such as a wireless local area network, wireless access point and the like. Preferably, the WLAN adapter 54 is compatible with one or more IEEE 802.11 protocols (e.g., 802.11(a), 802.11(b) and/or 802.11 (g), etc.) and allows the mobile telephone 10 to acquire a unique address (e.g., IP address) on the WLAN and communicate with one or more devices on the WLAN, assuming the user has the appropriate privileges and/or has been properly authenticated.

The processing device 32 and/or the control circuit 30 are generally provided on a printed circuit board. One or more of the functional components described above may be secured directly to the printed circuit board that contains the processing device 32 and the control circuitry 30 and/or be located remotely on a printed circuit board by itself and/or with other functional components. As discussed below, one or more of the printed circuit boards are secured to another printed circuit board using an electrical flex connector 100.

Figure 3:
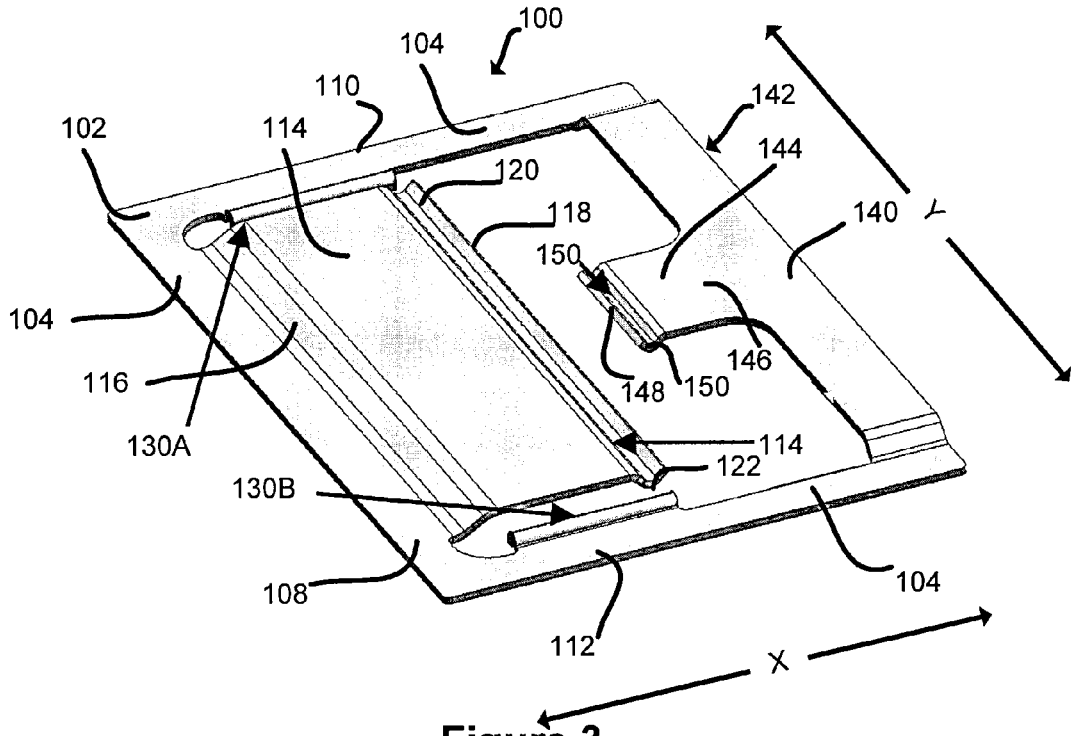
FIG. 3 is an exemplary electrical flex connector in accordance with aspects of the present invention.

Referring to FIG. 3, an electrical flex (female) connector 100 in accordance with aspects of the present invention is illustrated. The electrical flex connector 100 may be made from a conductive material or a non-conductive material depending on the design and the needs of the application. As shown in FIG. 3, the electrical flex connector 100 is formed from a body 102. In one embodiment, the body 102 is generally a unitary construction manufactured from a resilient material. For example, the electrical flex connector 100 may be manufactured from spring steel, titanium, steel, or any other resilient conductive and/or non-conductive material.

The electrical flex connector 100 may be manufactured in any desired manner. One manner of manufacturing the electrical flex connector 100 is by die cutting a desired material (e.g., spring steel) and applying compressive force on the body 102 to achieve the structure discussed below. One of ordinary skill in the art will readily appreciate that there are a variety of ways to form the electrical flex connector 100 in accordance with aspects of the present invention.

The body 102 includes a fixation portion 104 for affixing the electrical flex connector 100 to an associated printed circuit board 106 (illustrated in FIGS. 4 and 9) or another substrate for securing to the printed circuit board. The fixation portion 104 may have any desired configuration and may vary based on form factor, desired connection functionality and/or other criteria. As shown in FIG. 3, the fixation portion 104 includes a first side 108 formed between a second side 110 and a third side 112. As shown in FIG. 3, the fixation portion 104 is U-shaped and configured to receive a male flex connector (through the open end). The fixation portion 104 may be soldered or otherwise secured to a printed circuit board by an adhesive, tape or glue.

The electrical flex connector 100 includes a first tab member 114 for exerting a compressive force on an associated flex connector to securely hold the associated flex connector between the first tab member and the associated printed circuit board. As shown in FIG. 3, the tab member 114 extends upward from the first side 108 in a cantilever manner. As used herein, cantilever means a member supported at only one end.

The first tab member 114 generally extends from the first side 108 into a region defined by the second and third sides 110, 112 of the fastening portion 104. The first tab member 114 includes a first end 116 extending in a cantilever manner from the first side 108 and a second free end 118 having an edge portion 120 configured to facilitate receiving an associated flex connector. The second free end 118 of the first tab member includes a contact portion 122 adjacent the edge portion 120 for maintaining a secure connection between the contacts of the printed circuit board and the contacts provided on the flex connector, as described below.

The electrical flex connector 100 further includes alignment guides 130A and 130B. The alignment guides may be located on the second and third sides 110, 112 of the fastening portion 104. The alignment guides 130A, 130B may also be formed in the first tab member 114. The alignment guides facilitate alignment of the associated flex connector in a lateral direction (e.g., the y-direction as illustrated in FIG. 3). The alignment guides 130A, 130B may be positioned in any desired position. In one embodiment, alignment guides 130A, 130B are positioned a predetermined distance from the first side, wherein the predetermined distance may based on the length of the first tab member 114, the length of the first tab member 114 and/or any other design consideration. In another embodiment, the alignment guides may include a single alignment guide that functions in a similar manner as dual alignment guides.

The electrical flex connector 100 is generally configured to matingly engage with a male flex connector from another printed circuit board and/or other circuitry. The thickness of the electrical flex connector 100 is preferably less than 5 millimeters, more preferably less than 3 millimeters, and even more preferable approximately 1 millimeter or less. The thickness of the electrical flex connector 100 is preferably measured from the bottom of the fixation portion 104 to the top of the first tab 114 while in use and/or in a relaxed position.

The electrical flex connector 100 optionally may include a spanning member 140. The spanning member 140 may be formed in the body 102. The spanning member 140 extends upward from a plane formed from the second side 110 and third side 112 of the fixation portion 104. In one embodiment, the spanning member 140, when secured to the associated printed circuit board, forms a port 142 (shown in FIGS. 1, 7 and 9) with the associated printed circuit board for receiving the associated flex connector.

Figure 9:
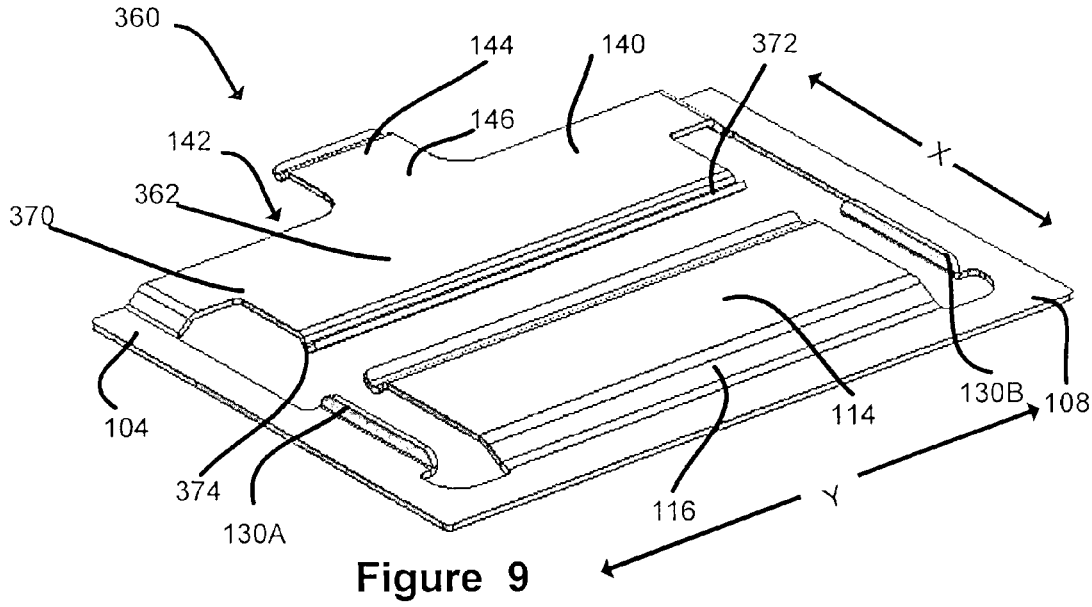
FIG. 9 is another exemplary electrical flex connector in accordance with aspects of the present invention.

The spanning member 140 may include a second tab member 144 formed therein. The second tab member 144 generally extends from the spanning member 140 toward the first side 108 of the fastening portion 104 to secure the flex connector cable in an axial direction (e.g., in the x-direction), as shown in FIG. 3. In another embodiment, the second tab member 144 may extend from the spanning member 140 in a direction opposite the first side 108 to secure the flex connector cable in an axial direction, as shown in FIG. 9. Like the first tab member 114, the second tab member 140 generally includes a first end 146 extending in a cantilever manner from the spanning member 140 and a second free end 148 having an edge portion configured to facilitate removal of the associated flex connector from the port. The second free end 148 of the second tab member 140 includes a contact portion 150 adjacent the edge portion for contacting and securing the associated flex connector.

Figure 4:
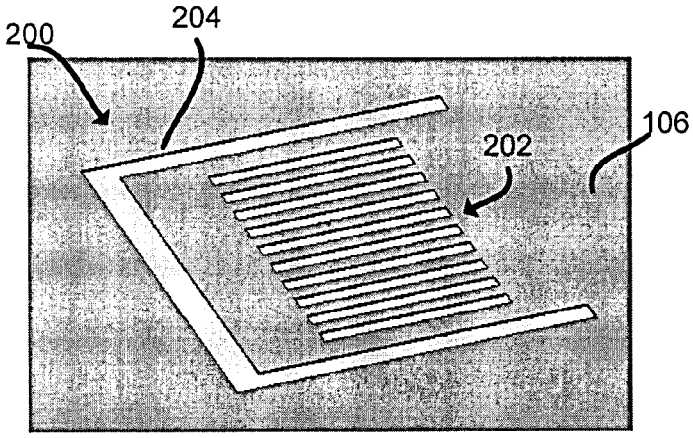
FIGS. 4-8 illustrate exemplary methods in accordance with aspects of the present invention.

Referring to FIGS. 4-8, a method of securing an electrical connector to a printed circuit board is illustrated. Referring to FIG. 4, one or more contact patterns 200 are formed on a printed circuit board 100. The one or more contact patterns 200 are shown formed in and/or otherwise secured to a printed circuit board 106. For purposes of clarity, only the contact pattern 200 and the printed circuit board 106 are illustrated. The contact pattern 200 may be any desired form and include multiple patterns. Generally, each contact that is electrically isolated from another contact in the contact pattern 200 corresponds to an independent signal that may receive and/or transmit signals to and/or from one or more circuits populated on the printed circuit board 106 and/or otherwise coupled to one of the contacts associated with the contact pattern 200.

For example, the contact pattern 200 includes two distinct patterns. The first pattern 202 corresponds to several independent signals that may be used to facilitate communication between printed circuit board 106 and another printed circuit board and/or circuit through a cable having corresponding contacts. The second pattern 204 extends generally around three sides of the periphery of the first pattern 202. The signal along all three sides of the second pattern 204 is generally substantially identical. The second pattern 204 may be used to provide a common ground signal to the connector 100 for use by connector 100 and the received male connector to provide ESD protection.

Figure 5:
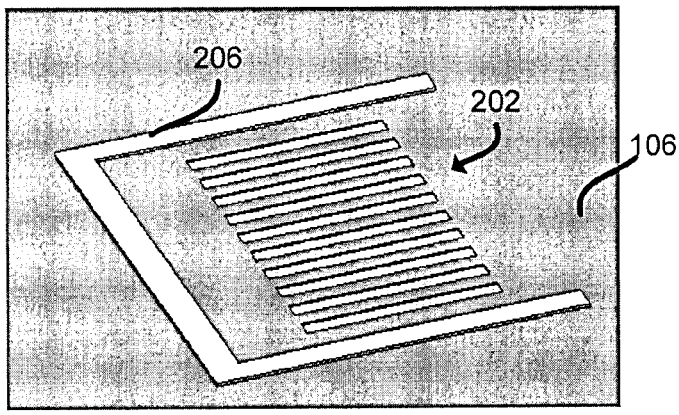

Referring to FIG. 5, a securing agent 206 is applied over at least a portion of the second pattern 204. The securing agent 206 and the second pattern 204, in this example, generally correspond to the fixation portion 104 of the electrical flex connector 100 to the printed circuit board 106. The securing agent 206 may be any soldering agent (e.g., tin paste), adhesive (e.g. pressure sensitive adhesive, curing adhesive, etc.), tape and/or glue, alone or in combination, that is capable securely mounting the electrical flex connector 100 to the printed circuit board 106. In one embodiment, the securing agent 206 is a solder pad that includes a soldering agent comprised of tin paste. The tin paste soldering agent functions to assist in the positioning of the connector on the pattern of the printed circuit board along the solder pad by the use of capillary forces when the solder pad is in a liquid state.

Figure 6:
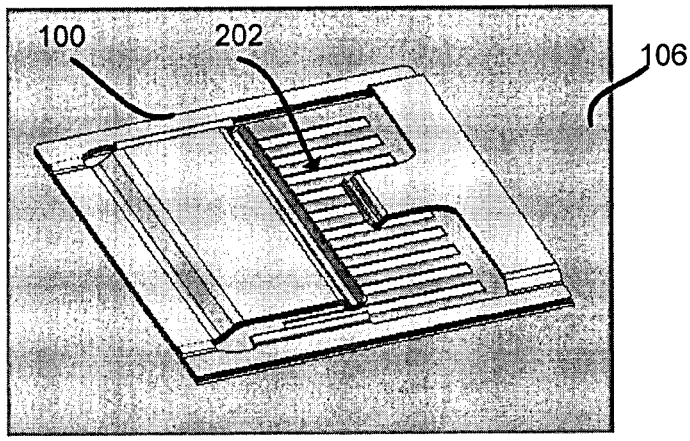

Referring to FIG. 6, an electrical flex connector 100, as described above is placed on the securing agent 206 (e.g., fixation pattern) to secure the electrical flex connector 100 to the printed circuit board 106. This may be accomplished by any means know in the art or later developed technology. For example, a pick and place machine may be used to securely place the connector 100 in the proper position on the printed circuit board 106. As show in FIG. 6, the electrical flex connector 100 is positioned over one or more contact patterns 200 that form an electrical connection from the associated printed circuit board 106 to the associated flex connector. When a soldering agent is used, it may be desirable to heat (or otherwise bake) at least a portion of the printed circuit board (e.g., the securing agent 206) in order to wet the soldering agent for affixing the connector to the printed circuit board. One advantage of using a tin paste soldering agent is that capillary forces associated with the tin paste soldering agent when in a liquid form function to properly position the connector on the printed circuit board. Generally the capillary forces are generated based on the configuration (e.g., size, thickness, orientation, geometry, etc.) of the securing agent on the printed circuit board.

Figure 7:
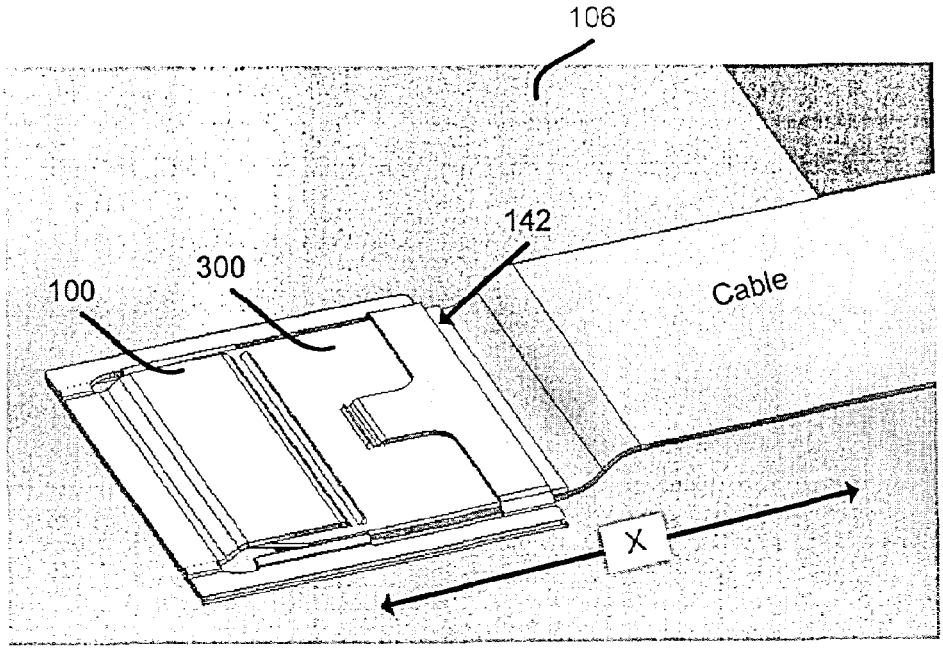

FIG. 7 illustrates a male flex connector 300 from a cable 302 affixed to the electrical flex connector 100. As shown in FIG. 7, the male flex connector 300 may be inserted and removed. Curved portions near the edges of the free ends 120, 152 allow easy insertion of the male connector 300 in to the electrical flex connector 100. The curved portions allow the tab members 114, 146 to bend upward and give way to the male flex connector 300 during insertion. Upon removal of the male flex connector 300, the tab members 114 and 146 preferably enter their relaxed positions. Preferably the distance between contact points 150 and 122 and the plane of the printed circuit board that forms the port for entry of the male flex connector 300, respectively is smaller in the relaxed state than when the male flex connector 300 is inserted into the port. This allows for increased mechanically stability of the male flex connector 300 in the female flex connector 100.

Figure 8:
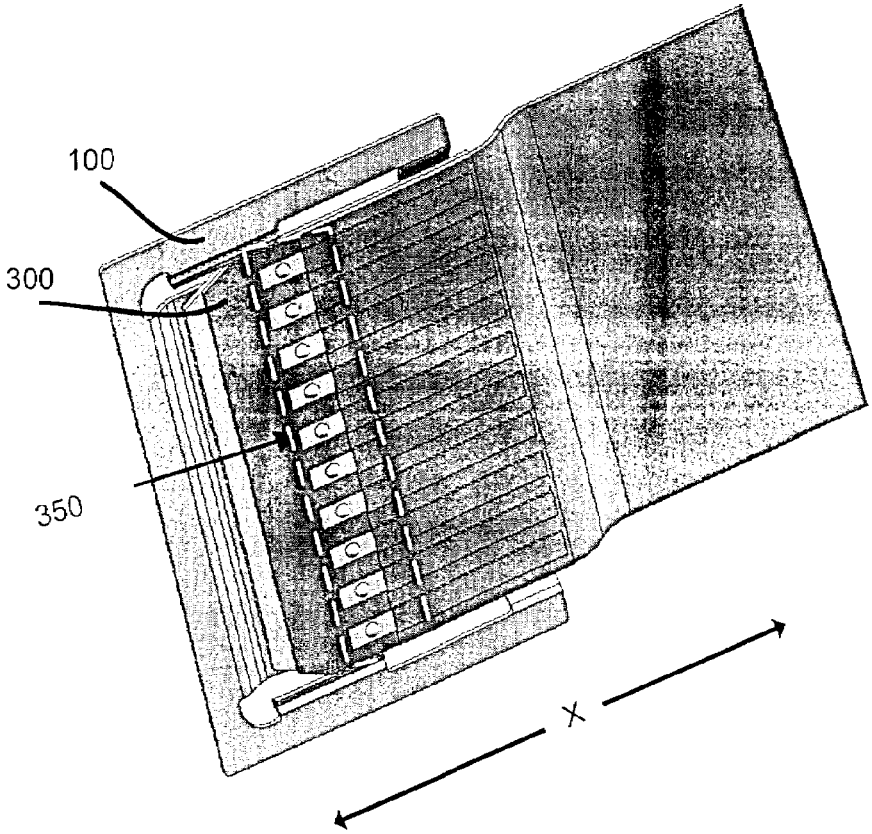

FIG. 8 illustrates a bottom view (with the printed circuit board removed) of the female connector 100 engages with the male connector 300. As shown, when the male connector 300 is fully engaged with the female connector 100, the contacts 350 of the male connector are positioned over the contact of the printed circuit board (not shown). The tab members 114 and 146 exert a compressive force against male connector 300 into the printed circuit board (removed for illustration purposes.

Figure 10:
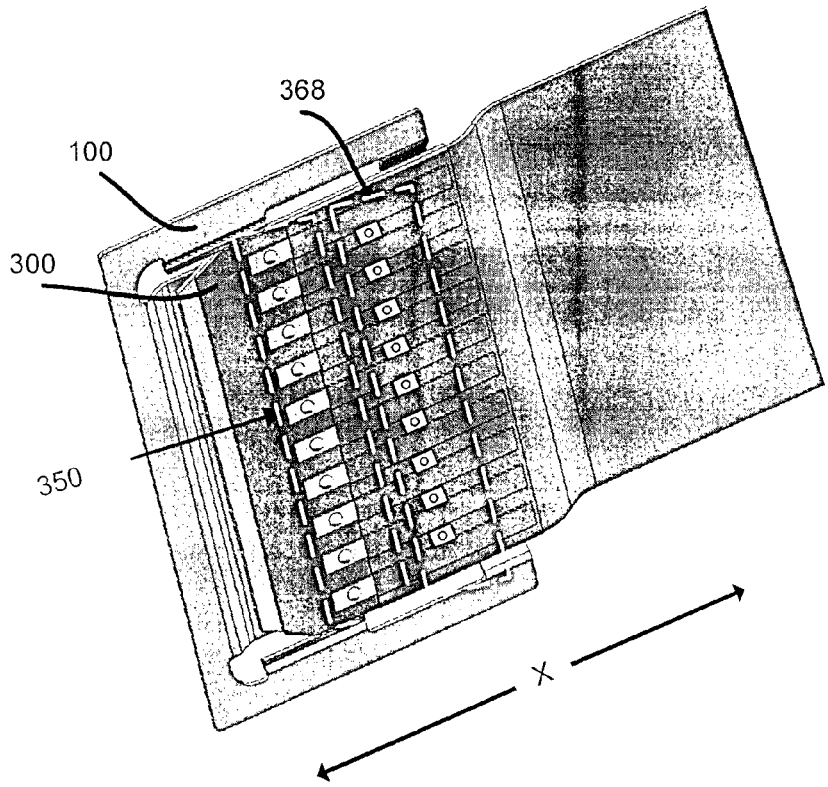
FIG. 10 is an exemplary illustration of a male connector engaging a female connector in accordance with one aspect of the present invention.

FIG. 9 illustrates another embodiment of female connector 360 in accordance with another aspect of the present invention. The female connector 360 includes a third tab member 362. The third tab member 362 may be configured to be any desired size and/or configuration. For example, the third tab member 362 may be the same size as the first tab member 114 and/or a size that is dependent on the number of contacts in which the third tab member 362 may be positioned over. The third tab member 362 may be positioned over another set of contacts 368, as shown in FIG. 10 for securing the contacts of the male connector to the contacts of the printed circuit board. The connector 360 optionally includes second tab member 144 for securing the male connector 300 to the printed circuit board.

The third tab member 362 generally includes a first end 370 extending from the spanning member 140 and a second free end 372 having an edge portion configured to facilitate insertion and/or removal of the associated flex connector from the port 142. The second free end 372 of the second tab member 362 includes a contact portion 374 adjacent the edge portion for contacting and securing the associated flex connector. Generally, the contact portion 374 extends toward printed circuit board and confines a portion of the port 142 when in its relaxed state. When a male connector is inserted, the contact portion 374 extends away from the printed circuit board and exerts a compressive force on the male connector.

In one embodiment, the third tab 362 is configured to be positioned over the contacts 368, as shown in FIG. 10. For example, when the male connector 300 is fully engaged with the female connector 360, the contacts 368 of the male connector are positioned over the contact of the printed circuit board (not shown) and the second set of contacts 368 of the male connector are positioned over corresponding contacts of the printed circuit board (not shown), in a similar manner as discussed above with respect to FIG. 8.

The contacts 368 may be electrically connected to contacts 350, be independent of each other, or some may be electrically connected and others may be independent. Such configuration allows the designer great functionality to securely mate a wide variety of contacts between the printed circuit board contacts and the contacts of the male connector 300.

Figure 11:
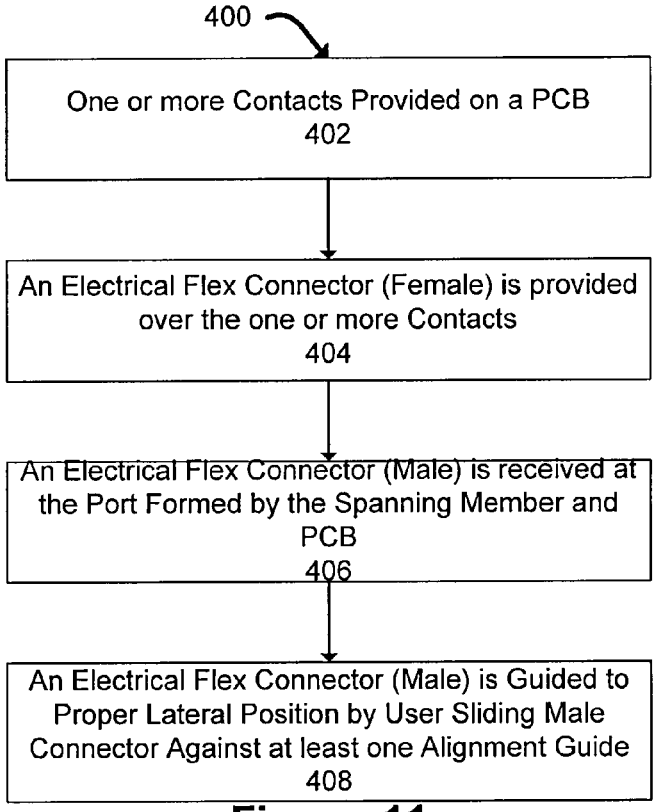
FIG. 11 illustrates an exemplary method in accordance with aspects of the present invention.

A method 400 of using an electrical connector provided on a printed circuit board is shown in FIG. 11. At block 402, one or more contact patterns are provided on a printed circuit board 106.

At block 404, an electrical flex connector (female) 100 is provided over the one or more contact patterns. The electrical flex connector 100 is identical to the connector 100 described above. At block 406, a male electrical flex connector 300 is received at the port formed by the spanning member and the printed circuit board 106. At block 408, the flex connector is guided to the proper lateral position by the user sliding the connector 300 against at least one of the alignment guides 130A and 130B.

During insertion of the male flex connector 300 through the spanning member 146 and upon engaging the second tab member 148, the flex connector exerts a force against the male flex connector 300, which causes the contact 150 of the free end 148 of the second tab member 146 to move upward (away from the printed circuit board 106) and allow the male flex connector 300 to traverse past the second tab member 146 and engage the first tab member 114. The edge 120 of the first tab member engages the male flex connector 300 and upon a sufficient amount of insertion force, the male flex connector 300 causes the free end of the first tab member 114 to move upward (away from the printed circuit board) and allows the male flex connector 300 to advance until the contacts of the male flex connector 300 are aligned with the corresponding contacts of the 200 associated with the printed circuit board 106. When the flex connector is properly positioned in the electrical connector, the second tab member 114 exerts a compressive force on the flex connector to maintain mechanical stability and electrical conductivity between the male flex connector 300 and the contacts of the printed circuit board.

Although the invention has been shown and described with respect to certain preferred embodiments, it is understood that equivalents and modifications will occur to others skilled in the art upon the reading and understanding of the specification. The present invention includes all such equivalents and modifications, and is limited only by the scope of the following claims.

What is claimed is:

1. An electrical connector for a printed circuit board, comprising:

a body having a fixation portion for affixing the connector to an associated printed circuit board, wherein the fixation portion includes a first side formed between a second and third side;

a first tab member extending from the first side, wherein the first tab member is configured to exert a compressive force on an associated flex connector to securely hold the associated flex connector between the first tab member and the associated substrate and the first tab member includes a first end extending in a cantilever manner from the first side and a second free end having an edge portion configured to facilitate receiving the associated flex connector, wherein the second free end of the first tab member includes a contact portion adjacent the edge portion for contacting the associated flex connector;

alignment guides on the second and third sides of the fixation portion, wherein the alignment guides facilitate alignment of the associated flex connector in a lateral direction, wherein the alignment guides are positioned a predetermined distance from the first side; and a spanning member formed in the body, wherein the spanning member extends upward from a plane formed from the second side and third side of the fixation portion and the spanning member when secured to the associated printed circuit board forms a port with the associated printed circuit board for receiving the associated flex connector.

2. The connector of claim 1, wherein the fixation portion is secured to the printed circuit board with a securing agent.

3. The connector of claim 2, wherein the securing agent is a soldering agent.

4. The connector of claim 3, wherein the soldering agent is a tin paste that when in a liquid form functions to position the connector on the associated printed circuit board by use of capillary forces.

5. The connector of claim 1 further including a second tab member extending toward the first side to secure the flex connector in an axial direction.

6. The connector of claim 5, wherein the second tab member includes a first end extending in a cantilever manner from the spanning member and a second free end having an edge portion configured to facilitate removal of the associated flex connector from the port.

7. The connector of claim 6, wherein the second free end of the second tab member includes a contact portion adjacent the edge portion for contacting the associated flex connector.

8. The connector of claim 7, wherein the body is manufactured from spring steel.

9. The connector of claim 7, wherein the connector is positioned over one or more contact patterns that form an electrical connection from the associated printed circuit board to the associated flex connector.

10. The connector of claim 1 including a second tab member extending from the spanning member in an opposite direction from the first side to secure the associated flex connector in an axial direction.

11. The connector of claim 10 including a third tab member extending from the spanning member toward the first side to secure the third tab member over one or more second contacts that form an electrical connection from the associated printed circuit board to the associated flex connector.

12. A method of using an electrical connector provided on a printed circuit board, the method comprising:

providing one or more contact patterns on a printed circuit board;

providing an electrical connector of claim 1;

receiving a flex connector at the port formed by the spanning member and the printed circuit board; and guiding the flex connector to the proper lateral position by sliding the connector against at least on of the alignment guides.

13. The method of claim 12 upon engaging the second tab member, the flex connector exerts a force against the second tab member free end causing the free end of the second tab member to move and allow the flex connector to traverse past the second tab member and engage the one more or more contacts of the printed circuit board.

14. The method of claim 12, wherein when the flex connector is properly positioned in the electrical connector, the second tab member exerts a compressive force on the flex connector.

15. The method of claim 12, wherein upon engaging the first tab member, the flex connector exerts a force against the first tab member free end causing the free end to expand and allowing the flex connector to traverse below the first tab member and engage the one more or more contacts of the printed circuit board.

16. The method of claim 12, wherein when the flex connector is properly positioned in the electrical connector, the first tab member exerts a compressive force over at least a portion of flex connector contacts engaging the contacts on the printed circuit board.

17. A method of securing an electrical connector to a printed circuit board, the method comprising:

forming one or more contact patterns on a printed circuit board;

providing an electrical connector including a body having a fixation portion for affixing the connector to the printed circuit board, wherein the fixation portions includes a first side formed between a second and third side; a first tab member extending from the first side, wherein the first tab member is configured to exert a compressive force on an associated flex connector to securely hold the associated flex connector between the first tab member and the associated printed circuit board; and a scanning member formed in the body, wherein the scanning member extends upward from a plane formed from the second side and third side of the fixation portion and spaced apart from the first side; wherein the scanning member when secured to the associated printed circuit board forms a port with the associated printed circuit board for receiving the associated flex connector;

adhering a fixation pattern that corresponds to the fixation portion of the electrical connector to the printed circuit board, wherein the pattern is provided around at least a portion of the one or more contact patterns formed in the printed circuit board; and placing the electrical connector on the fixation pattern with a compressive force.

18. The method of claim 17, wherein the connector is placed on the fixation pattern of the printed circuit board with a pick and place machine.

* * * * *